US007107623B2

(12) United States Patent
Hatch et al.

(10) Patent No.: US 7,107,623 B2
(45) Date of Patent: Sep. 19, 2006

(54) COMPOSITE GLOVE STRUCTURE

(75) Inventors: William Hatch, Ojai, CA (US); Michael W. McCarey, Camarillo, CA (US)

(73) Assignee: Armor Holdings, Inc., Jacksonville, FL (US)

( * ) Notice: Subject to any disclaimer, the term of this patent is extended or adjusted under 35 U.S.C. 154(b) by 0 days.

(21) Appl. No.: 11/064,660

(22) Filed: Feb. 23, 2005

(65) Prior Publication Data

US 2005/0183184 A1 Aug. 25, 2005

Related U.S. Application Data

(62) Division of application No. 10/341,487, filed on Jan. 14, 2003, now Pat. No. 6,912,732, and a division of application No. 10/152,580, filed on May 23, 2002, now Pat. No. 6,760,924.

(60) Provisional application No. 60/292,525, filed on May 23, 2001.

(51) Int. Cl.
*A41D 19/00* (2006.01)

(52) U.S. Cl. ..... 2/161.5

(58) Field of Classification Search ..... 2/16, 2/20, 161.5, 161.6, 163
See application file for complete search history.

(56) References Cited

U.S. PATENT DOCUMENTS 474,929 A 5/1892 Tabor et al.
4,094,014 A 6/1978 Schroeder
4,704,743 A 11/1987 Thornell et al.
4,881,276 A 11/1989 Swan
5,113,532 A 5/1992 Sutton
5,187,815 A 2/1993 Stern et al.
5,228,142 A 7/1993 Yoswein-McGreen
5,697,104 A 12/1997 Welton
5,745,919 A 5/1998 Kraatz
6,760,924 B1 * 7/2004 Hatch et al. ..... 2/161.5
6,912,732 B1 * 7/2005 Hatch et al. ..... 2/161.1

* cited by examiner

*Primary Examiner*—Katherine M. Moran
(74) *Attorney, Agent, or Firm*—Michael G. Gilman

(57) ABSTRACT

A rappeller's glove, that is adapted to be used as a pair on both hands of a person who is rappelling. The rappeller's glove is made up of a portion of film form material that covers the user's palm; digit portions extending outwardly from the palm portion, and preferably extending only partially up the digits that they are intended to cover, that are made up at least partially of film form material; a plurality of effectively discrete padded areas disposed on said palm portion; and a protective film overlay disposed over said discrete transverse padding areas adhered by stitching or otherwise to the palm portion to thereby define the plurality of padded areas, and covering an area including the place where the fingers and the main body portion of the user's hand are joined. Means to hold the glove tight against the wearer's wrist are disposed at the base of the glove. A composite of a rappeller's glove overlying a shooter's glove is also disclosed. The shooter's glove is made up of a palm covering portion with a padded heal area; material extending from the palm covering portion sufficient to cover at least a portion of the fingers of the user and elastic means adapted to hold the glove close to the hand. At least one cut ring is disposed about at least one digit portion of the shooter's glove so that the tip of a digit portion can be uncovered without the remainder of the textile fabric material making up the glove unraveling. This allows the wearer of the composite glove to enable the end joint of the covered digit to easily articulate and to provide for direct contact with a weapon or other firing mechanism that enables increased sensitivity for safe and effective operation.

9 Claims, 3 Drawing Sheets

COMPOSITE GLOVE STRUCTURE

This application is a continuation in part of provisional patent application 60/292,525 filed May 23, 2001. This application is a division of application Ser. No. 10/341,487 filed Jan. 14, 2003 now U.S. Pat. No. 6,912,732, and of application Ser. No. 10/152,580 filed May 23, 2002, now U.S. Pat. No. 6,760,924. The entirety of both applications is incorporated herein by reference.

This invention relates to a glove structure. It more particularly refers to a glove that is specifically designed for use by law enforcement and military personnel in order to protect the wearer's hands from abrasion during rappelling operations. The glove of this invention provides enough dexterity to enable the user to handle weapons and equipment without having to remove the outer, rappelling glove prior to handling such weapons and equipment

BACKGROUND AND PRIOR ART

Professional shooters, such as for example members of SWAT teams and military personnel, often wear gloves as part of the equipment associated with the firearm that they are called upon to handle. It is common for such gloves to be made wholly or partly of an antiballistic material in order to offer protection to the shooter's hand(s) while they are exposed. It is also common for the shooter to modify a newly acquired glove by removing a portion of the glove's trigger finger. This enables the shooter to have a better "feel" for the pull of the trigger and therefore the shot can be more accurate.

While the removal of the distal portion of the glove's trigger finger may be important to insure a good trigger feel, it is also disadvantageous in that the removal of this portion of the glove's trigger finger is often accomplished by the shooter simply cutting off the distal end of the finger portion of the glove with a knife or scissors. Since most shooter's gloves are made of woven or knitted material, this action cuts the threads of the material from which the glove has been made. This will likely causes the fabric of the remainder of the glove/finger body to unravel. In a very short time, the glove fabric unravels sufficiently so that at least the trigger finger, and possibly the whole glove, becomes relatively useless.

In one aspect of the prior art, cut rings have been provided on more finger elements than just the index or trigger finger. Therefore, a plurality, or even all, of the finger elements may be equipped with one or more cut rings and a suitable number of finger tip elements removed at the user's will.

It is also common for professional shooters to use shooting gloves made of materials that are flame and powder flash resistant. Gloves made of these same materials are often worn by aviators as well. One specific material that has been used for making shooter's gloves is NOMEX®. This material has excellent fire resistance, but is less resistant to penetration by a knife or other cutting threat than would be desirable. NOMEX is less resistant to being cut by flying glass or metal particles than is desirable.

It has been found to be desirable for conventional shooter's gloves to fit with about the same, or even increased, snugness as in the manner of ordinary gloves that are conventionally used to protect the hands against cold. While a loose fit increases insulation against penetration by cold ambient conditions, this loose fit can cause slip between the weapon and the hard of the shooter. Such slippage can detract from the accuracy of a shot.

Loose fitting of a glove is advantageous where warmth is the reason for wearing the glove. However, it can be a disadvantage where the glove covers the hand of a shooter whose accuracy of shot is of paramount importance. The extra material that is used to make a glove body fit loosely, and to thereby increase its warmth retention characteristics, can be an obstruction to accuracy in the case of a shooting glove. It is therefore well known that shooting gloves should have as snug a fit as possible, suitably a skin tight fit.

It is common for law enforcement and military personnel to be required to rappel as part of their deployment. Rappelling requires that the rappeller's hands be gloved so that they can slide down a rope to permit the rappeller to reach an objective. The rappelling glove protects the hands of the rappeller from burning as he slides down the rope. At the same time, the friction between the rope and the glove causes the material from which the glove is made to deteriorate. It does not take a great many rappelling actions for the glove to be substantially worthless as a rappelling glove.

Importantly, shooter's gloves as described herein and in the parent applications are relatively expensive. They are made of certain specific materials that enable the shooter to have a firm grip on his weapon while at the same time enabling the shooter's hands to maintain their warmth and giving the shooter a good trigger feel. Some of the materials of construction are antiballistic fabrics, which are inherently expensive. A shooter's glove is designed for maximum contact between the shooter and the weapon. It is inherently not designed to protect a rappeller's hands from burns inflicted by sliding down a rope. When a shooter's glove, designed as set forth herein and in the parent applications, is used for rappelling, it wears out so fast that the shooter cannot get full value from his investment in the expensive shooter's glove. Similarly, previous gloves that have been made specifically for use in rappelling are stiff and bulky with padding in order to protect the hands, particularly the palms, of the rappeller against burns caused by rope sliding. As such, prior rappeller's gloves tended to make for impeded shooting accuracy.

OBJECTS AND GENERAL STATEMENT OF THE INVENTION

It is an object of this invention to provide a novel rappeller's glove.

It is another object of this invention to provide a rappeller's glove that is designed especially to cooperate with a shooter's glove so as to provide a composite structure that assists personnel in both rappelling and shooting while at the same time not being prohibitively costly.

It is a further object of this invention to provide a novel rappeller's overglove that need not be removed after rappelling in order to adequately handle a weapon or other equipment.

Other and additional objects of this invention will become apparent from a consideration of this entire specification including the drawing that is an integral part thereof.

In accord with and fulfilling these objects, one aspect of the instant invention lies in a novel rappeller's glove construction that is particularly well suited to use by professional law enforcement and military personnel. Another important aspect of this invention lies in a combination of the novel rappeller's glove of this invention with a shooter's glove. In this regard, the rappeller;s glove and the shooter's glove may be overlayed each other without any fastening between these gloves, or snaps or other attachment means for releasably attaching the outer, rappeller's glove to the inner, shooter's glove. This combined glove structure of this invention can be used in combination for rappelling followed by shooting without separating the inner glove from the outer glove, or in some cases, the outer glove may be stripped off after rappelling and the shooter's glove used against a weapon or the like.

An excellent shooter's glove construction has been described in the above referenced prior patent applications. It suitably comprises a body portion that is commensurate in size and shape of, and is intended to cover, at least the palm portion of a human hand. The glove may also be tailored to cover the back of the shooting hand and it will cover some or all of all or one or mole portions of the shooters'fingers. The glove may be left or right handed depending on the specific shooter that it is made for. Suitably, the shooter's gloves of this invention are made in pairs as mirror images so that a purchased pair of gloves will be suitable for both a left and a right handed shooter. In a preferred aspect of tills invention, each glove is tailored to the specific hand that it is intended to cover so that a snug fit is ensured. One adjunct aspect of the shooter's glove of this invention provides that the glove is at least partially composed of insulating materials, for retention of warmth without departing from the snug fit provision, as well as anti-ballistic material, for protection.

The body portion of the shooter's glove suitably has attached to its proximal end a gauntlet that is of a size and shape that can cover at least a portion of the forearm of the wearer. This is an optional structure. At or near the attachment of the gauntlet to the body portion of the shooter's glove, there is provided elastic means that at least partially pass around the glove body sufficient to serve to hold the proximal portion of the body portion of the glove relatively tightly about the wrist of the wearer. The tightness of fit about the wrist is not concerned with closing off the glove to penetration of external materials. Rather, this tight fit tends to insure that the glove body and finger elements will be pulled down oil the wearer's hand so as to maintain a snug fit of the glove on the hand and tends to prevent bunching up of the glove material.

In some cases, the gauntlet portion is integral with the body portion. In some cases, the elastic portion is built into the structure of the glove/gauntlet. In some situations, these two elements, the glove and the gauntlet, can be separately constructed and then joined together to construct the total glove/gauntlet assembly. The gauntlet can be permanently or detachably attached to the glove body. The glove material covering the back of the hand and/or other fingers will also be pulled tight toward the forearm by the elastic band about the wrist area. Thus, this structure maintains the glove in a snug fit and in close proximity to the covered portions of the hand at all times. Thus, the shooter's glove does not tend to slip away from the wrist and off the fingertips or to have material that bunches up. In a preferred embodiment, a removable adjusting strap can be provided on the underside of the glove.

In a preferred embodiment of this shooter's glove, the gauntlet is terminated, at its proximal end, with an additional circumferential elastic means sufficiently sized and with enough elasticity, to hold the gauntlet against the wearer's forearm, preferably over the forearm muscle for a length that extends to the elbow or at least to closely below the elbow. This forearm circumferential elastic band substantially isolates the wearer's hand and forearm from the intrusion of foreign objects between the glove and the hand and therefore prevents dangerous materials, such a broken glass, from coming into proximity with the wearer's skin. Of particular importance in this regard is the exclusion of bullet casings and/or broken glass or other frangible objects that could cause cutting of the shooter's skin or other damage from contact with the shooter's skill.

Except for the circumferential elastic bands about the proximal end of the gauntlet, and at or near the juncture of the gauntlet and the glove body, the gauntlet can be either tight fitting or loosely draped about the wearer's forearm. In an embodiment of the preferred shooter's glove that will form a combination with a rappeller's glove according to this invention, the material from which the gauntlet is omitted.

Portions of the glove of this invention are preferably fashioned of anti-ballistic materials. Literally dozens of antiballistic materials are known and available in textile form and are quite suitable for use in making all or part of the body of the instant shooter's glove, as well as all or part of the instant rappeller's glove.

In a most preferred embodiment of the shooter's glove that is used herein, the body, fingers, and perhaps other elements of the gloves of this invention, are made from a textile (suitably knitted or woven) fabric that is formed at least partially from high tenacity aramide fibers/filaments, such as the material sold commercially under the trademark KEVLAR®. There are other antiballistic filamentary material that can form the basis of the glove materials of the gloves that is used in this invention, such as poly(1,4-phenylene-2,6-benizbisoxazole), in yarn or monofilament form sold under the name PBO. Many other materials, such as ultra high molecular weight polyethylene, sold in this art under the name SPECTRA®, are known. This list is exemplary and should not be taken as in any way limiting on the scope of the glove of this invention. The aspect of the instant invention that pertains to the shooter's glove structure is intended to make use of substantially any material, especially any anti-ballistic material, that is available. The material from which the shooter's glove portion of this invention is made can be per se conventional, and not form a distinct part or the instant invention. However, it is preferred that the materials of construction be selected with care so as to produce a glove that not only protects the hands of the wearer from external damage, such as from flying broken glass or even knife wounds The textile fabrics from which the shooter's portion of the instant composite glove are made are preferably woven or knitted of yarn rather than monofilament because of its softer and more comfortable feel. However monofilament can be used in selected portions of the glove because it is stronger than yarn for the same total denier. The fabric portion of the shooter's glove portion of this invention can be made exclusively of antiballistic filaments and/or yarns or it can be made of yarns that are made up partially of antiballistic fibers and partially of other fibers/filaments. Specifically, known elastic yarns or monofilaments can be admixed with antiballistic fabric materials in order to make the shooter's glove portion of the composite glove of this invention conform even more closely to the wearer's hand. In this respect, elastic or other yarns can be selectively located where they will be most effective in conforming the composite glove of this invention to the wearer's hand while at the same time, protecting the shooter's hand from any and all injuries.

Suitably sized and shaped finger and thumb elements extend from the distal end of the shooter's glove body. These too are made so as to provide a snug fit. One important aspect of the shooter's portion of the composite glove stricture of this invention is the provision of at least one cut line located between the fingertip end of the trigger finger element and the remainder of the trigger finger portion of the glove body. Suitably, a cut line may circumscribe the entire trigger finger (usually the index finger) glove element, or it may be made up of plural transversely (circumferentially) spaced cut lines that collectively circumscribe the trigger finger. It is possible to provide a cut line that does not entirely circumscribe the trigger finger. Rather, the cut line may circumscribe a sufficient portion of the trigger finger to allow the distal portion of the glove finger to be "pealed back" to as to expose so much of the trigger finger, that is preferably the first, or first and second knuckles, that enables accurate shooting while at the same time enabling the trigger finger to be covered with a glove element before and after the shooting actually has occurred. These comments about the structure of the cut line are not limited to the trigger finger, but can be applied to one or more cut lines disposed about any, or even a plurality, of the finger elements of the instant glove.

The important consideration of cut line of the shooter's glove portion of this invention is that it is designed and located such that a cut in the textile portion of a finger element that is located between the finger tip and the cut line will not unravel the textile portion of the glove body beyond the cut line. In this regard, a plurality of cut lines can be employed so as to enable the user to have a custom length of finger element.

Where the trigger finger element is made of a composite of different materials, such as for example textile material on the backside and leather or plastic material on the palm side of the finger element, it is only absolutely required that the textile fabric portion of the index finger element have a cut line stitched into it. Although it is considered to be within the scope of this invention to provide a cut line through all of the materials from which the finger element(s) are made, if the cut line does not extend through a leather or otherwise non-textile portion of the finger element, that will be satisfactory because cutting a non-textile (e.g. leather or plastic) portion of the finger element will not cause it or other construction materials to unravel. The material other than the textile material will not unravel even if it is directly cut without the benefit of a cut line and therefore, an unravellable place need not be specifically provided for supporting cutting of this element. It is recognized that there are textile materials, bonded non-woven fabrics, that will not unravel when cut. These are not considered to be textile materials from the perspective of the unravelable textile materials of this invention.

One preferred aspect of this invention resides in a finger element that has a leather or plastic on the palm side of one or more finger elements with a woven or knitted material on the "back" side of the finger element(s). Suitably, a leather or plastic strip can be sewn around at least the fabric portion of the finger element, such as on the "back" side of the finger element. Plural leather or plastic strips can be sewn around the woven/knitted portion of at least one of the finger elements. This enables the wearer to select how much of his finger(s) to expose. It is an important consideration of this invention, however, that the cut ring, whether it is merely circumferential stitching or stitching through a leather or plastic strip, or adherence of the woven/knitted threads together by means other than stitching, such as gluing or fusing of the fibers must act to prevent substantial unraveling of the thread material after it has been cut. It is considered to be within the scope of this invention to enable cutting of the distal portion of a finger element some distance away from the cut line and to therefore permit some unraveling down to the cut line.

The cut line is preferably located about at a point on the shooter's trigger finger that provides easy access through the trigger guard and to the trigger while maintaining full mobility of that finger. The exact location can be moved toward or away from the fingertip portion of the finger glove element to suit the wearer's preferences. Plural spaced apart cut lines are preferably provided so that the shooter has the option of removing as much or as little of the trigger finger covering as is preferred.

The cut line is so constructed that the finger element(s) of the glove, preferably, but not exclusively the trigger finger element, can be transversely cut through at the cut line without causing the rest of the material of the index finger glove element to unravel. It is considered to be within the scope of this invention for there to be more than one finger element that contains the invented cut line. This embodiment envisions a full fingered glove being convertible to a half fingered glove at the option of the wearer, for example during warm weather. Where the cut line is disposed on the trigger finger, suitably the shooter's index finger, the distal ends of the trigger finger can be partially exposed sufficient to enable to shooter to have excellent contact between the trigger finger and the trigger with no opportunity for the remainder of the finger element material to unravel.

A preferred element of the shooter's glove, that was previously described in the referenced parent applications, lies in the fact that the palm side of the glove body, and preferably the palm side directed portions of the finger elements as well, are made up of at least partially of a layer of a slip resistant, high friction, pliable material. This material may make up the entirety of the glove body and finger elements, or it may constitute all or part of the palm side of the glove body and/or finger element(s), in which case it can be stitched or otherwise attached to other fabric (suitably knitted) that covers the back of the hand and fingers. In the alternative, the glove may be entirely made of fabric, preferably antiballistic knitted/woven fabric, and the high friction material attached to the fabric as an overlaid second layer. In another alternative, the glove of this invention may have portions of the palm side constructed of high friction material and other portions constructed of knitted/woven material, suitably, but not necessarily, anti ballistic fabric.

The several different layers and elements of the glove of this invention may be attached to each other by conventional stitching. Alternatively, these elements may be glued together with a suitable flexible glue. Where appropriate, elements of the gloves of this invention may be made of breathable, water resistant materials such Gortex® or the like.

While the use of such a high friction or limited slip materials is excellent for the palm portions of a shooter's glove, it can be a significant detriment to a rappeller's glove. Rappellers must have excellent sliding relationship with the rappelling rope. At the same time, the structure and material from which at least the palm and palm directed portions of the finger elements of a rappeller's glove are made must enable the rappeller to adjust his grip on the rope to enable him to slide down the rope at a faster or slower rate, and to enable him to stop his downward slide if required.

Thus, the functional requirements of the palm directed portions of a rappeller's glove (that is an overlay strip that will be further detailed below) can be completely antithetical to the requirements of a shooter's glove. The shooter's glove must enable a sure grip, with non, or limited, slip contact with the weapon; while the rappeller's glove must make controlled sliding, relatively high slip, contact with a rope. When the shooter's glove described herein has been used for rappelling, it has been found that the palm and finger portions of the glove wear (burn) out very rapidly. This remarkably increases the cost of the shooter's glove while not providing sufficient protection to the hand of the rappeller. To the contrary, where a rappeller's glove has been used by a shooter, it has been found that slippage, if any, between a new glove material and the weapon can have a disadvantageous effect on the shooting accuracy. Further, it has been found that, surprisingly, after the rapeller's glove of this invention has been used a few times, the surface of the overlay strip becomes much more attuned to handling a weapon, such as a rifle stock, with a sure grip.

According to another aspect of this invention, a rappeller's glove is provided. The rappeller's glove of this invention can be used alone, as can the shooter's glove, or the rappeller's glove and the shooter's glove can be used in combination as a composite structure. It has been found that the specially designed rappeller's glove of this invention is quite suitable for use as an over layer worn on top of the shooter's glove. It has also been unexpectedly found that, even though the palm protecting portion (overlay strip) of the rappeller's glove is preferably more slippery than is the optimum palm portion of the instant shooter's glove, after the rappeller has used just a few times, the palm protecting material becomes sufficiently changed (abraded) that it provides good close contact between the rappeller's hands and the weapon or other equipment. Although removal of the rappeller's portion of the instant composite glove structure before shooting is an option that can be exercised by the wearer, unexpectedly, it has been found that when a shooter-rappeller wears the composite glove structure of this invention, it is not necessary to remove the rappeller's glove portion before being able to handle a weapon and shoot with great accuracy. Thus, the transition from rappelling to shooting now takes much less time than with prior products where a separate rappeller's glove had to be removed and a shooter's glove put on before the transition from rappelling to shooting was complete. While this desirable result was unexpected, having discovered this attribute now makes the use of the composite glove structure of this invention a technically desirable situation that is intentionally used by rappeller/shooter personnel.

The rappeller's glove of this invention comprises a body portion, with extra padding in the palm area, and finger elements, suitably elements that extend from a palm portion only partially up the fingers of the wearer. The shortened (partial coverage) length of the finger elements is such that they do not interfere with articulation of the trigger finger, or other fingers, of the wearer. The reinforced palm portion of the rappeller's glove is suitably faced with a material that, at least initially, has a relatively low coefficient of friction with respect to the rappelling rope. Preferably, this facing material is natural or synthetic leather or plastic.

Padding is provided between this facing material, of at least the palm portion of the glove, and the portions of the glove body that are directed toward the wearer's palm so as to protect the rappeller's hands from burning during a rappel. In a preferred embodiment of this aspect of this invention, the reinforced palm portion of the rappeller's glove is made of leather, preferably kangaroo leather, the back portion of the glove is made of an elastic material, and the padding portions are made of anti ballistic materials such as high molecular weight polyaramide, polyolefin or PBO fabrics. In other embodiments, other elements of the instant gloves may also be made of anti ballistic materials in order to increase the protection against threat as well as to absorb the high frictional heat generated during rappelling.

In one embodiment of this rappeller's glove aspect of this invention, the palm facing material, and optionally including its underlying padding, may be relatively permanently physically attached to and constitute an integral part of the remainder of the glove body. Thus, in this embodiment, when the facing and the padding are no longer able to protect the rappeller's hands because they have been worn out by contact with the rope, the whole glove is discarded and a new one(s) must be purchased. However, it is another embodiment of this aspect of this invention to detachably attach the facing, and perhaps the padding portion as well, of the rappeller's glove to the glove body so that when they have become sufficiently warm, they can be removed and replaced without having to discard the whole rappeller's glove body as well.

The rappeller's glove of this invention is primarily intended to be worn over the shooter's glove described herein. However, the rappeller's glove of this invention can also be used without the shooter 's glove understructure. In this latter case, the rappeller's glove will necessarily be somewhat smaller, providing a closer fit, than in the case where it is intended to be worn over the shooter's glove.

In one aspect of the rappeller's glove of this invention, a wrist strap is provided suitably across the back of the glove. This wrist strap acts to tighten the glove body about the wrist of the wearer so that during rappelling, the glove will not be pulled off the wearer's hand. The wrist strap can be permanently attached to the glove body at one end and the other end can be constructed so that it can be made tighter or looser depending on the wearer's preference. One convenient attachment means is a conventional hook and eye structure that is sold commercially under the mark VELCRO®. The end of the strap that is permanently affixed to the glove body can be attached by sewing or gluing. In one embodiment, both end of the wrist strap can be removably attached to the glove body, such as by providing hook and eye elements at both ends of the strap. The strap itself can be made of an elastic material, or it can be formed from a material that has little or no elasticity. Web material has been found to be particularly useful fore this aspect of this invention.

It is recognized that composite glove structures are generally well known for use in connection with winter sports, such as skiing. In those structures, the inner glove is generally made of a material that is intended to keep the wearer's hands warm. Usually, the inner glove is made of knitted wool or the like, which is very warm but does not have significant structural strength and abrasion resistance. The outer glove in these known composite structures is generally made of leather, or the like, and has the characteristics of being fashionable. Friction between the inner fabric and the outer leather glove elements is usually minimized so as to make it easier to assemble the composite. In contrast, in the instant composite glove structure, the outside of the shooter's glove, which is the inner glove element of the composite structure of this invention, is arranged such that it will have a high coefficient of function with respect to the interior of the outer glove body. This tends to retard or prevent movement of the inner and outer gloves relative to each other. Where the shooter's glove of this invention is used alone, this higher friction surface resists movement of the glove on or in relation to a weapon. In contrast, the outer glove element (the rappeller's glove) at least initially has a lower coefficient of friction so that it will more easily slide down the rappelling rope while generating less frictional heat. This is exactly opposite to the surface characteristics of a conventional composite glove structure.

Importantly, the composite glove of this invention actually saves substantial amounts of time relative to the prior art rappeller's gloves. With prior art rappeller's gloves, the wearer had to remove the rappeller's glove and then don the shooter's glove before he was in condition to fulfil his role. Clearly, the instant composite glove is an improvement over the state of the art.

BRIEF DESCRIPTION OF THE DRAWING

Understanding of this invention will be facilitated by reference to the accompanying drawing in which.

DETAILED DESCRIPTION OF THE INVENTION

Figure 1:
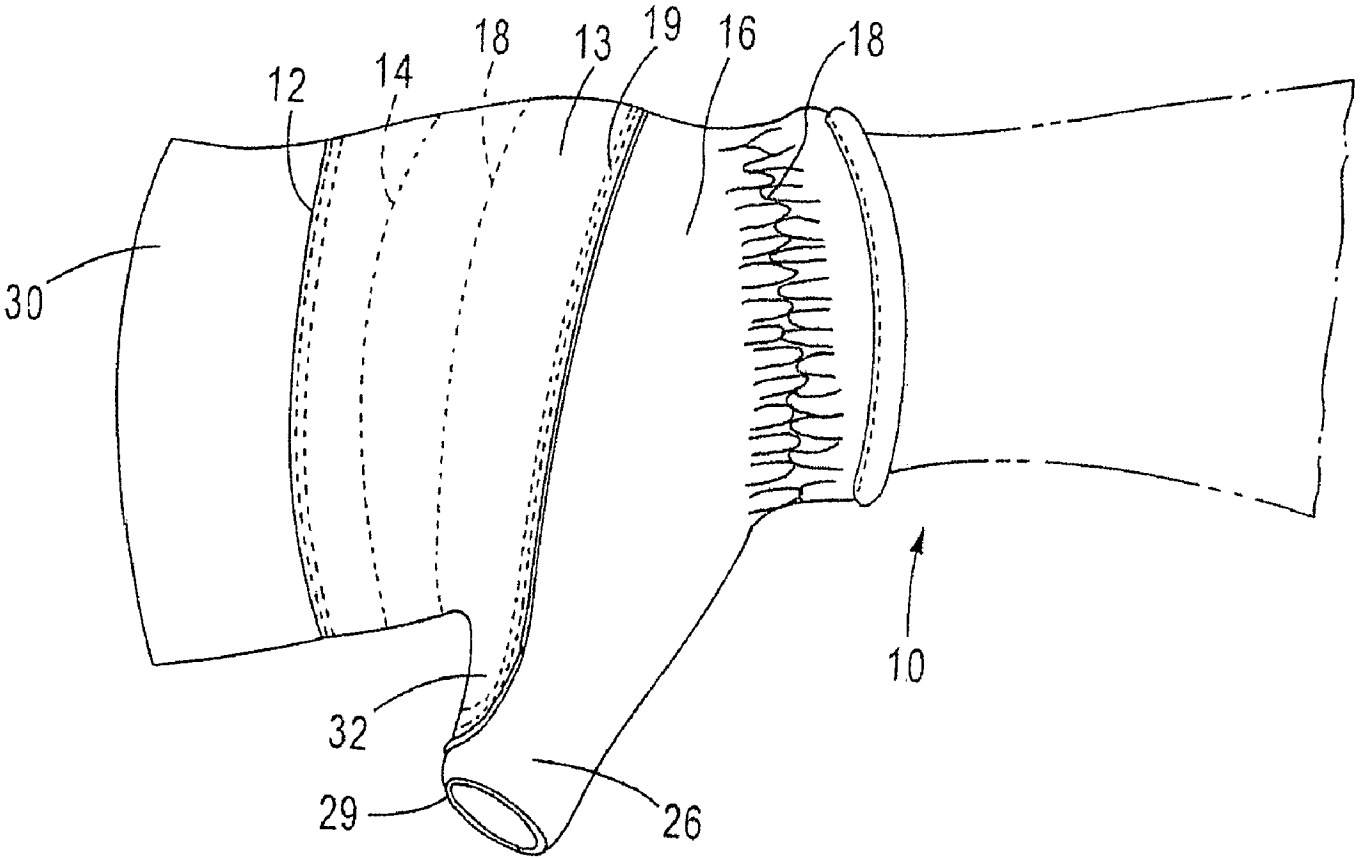
FIG. 1 is a perspective view of a rappeller's glove according to this invention viewed from the front of the glove.

Reference will hereafter be made to a description of a preferred aspect of the glove of this invention in relation to the several figures of the drawing. Like parts will be identified with like reference numerals.

Figure 2:
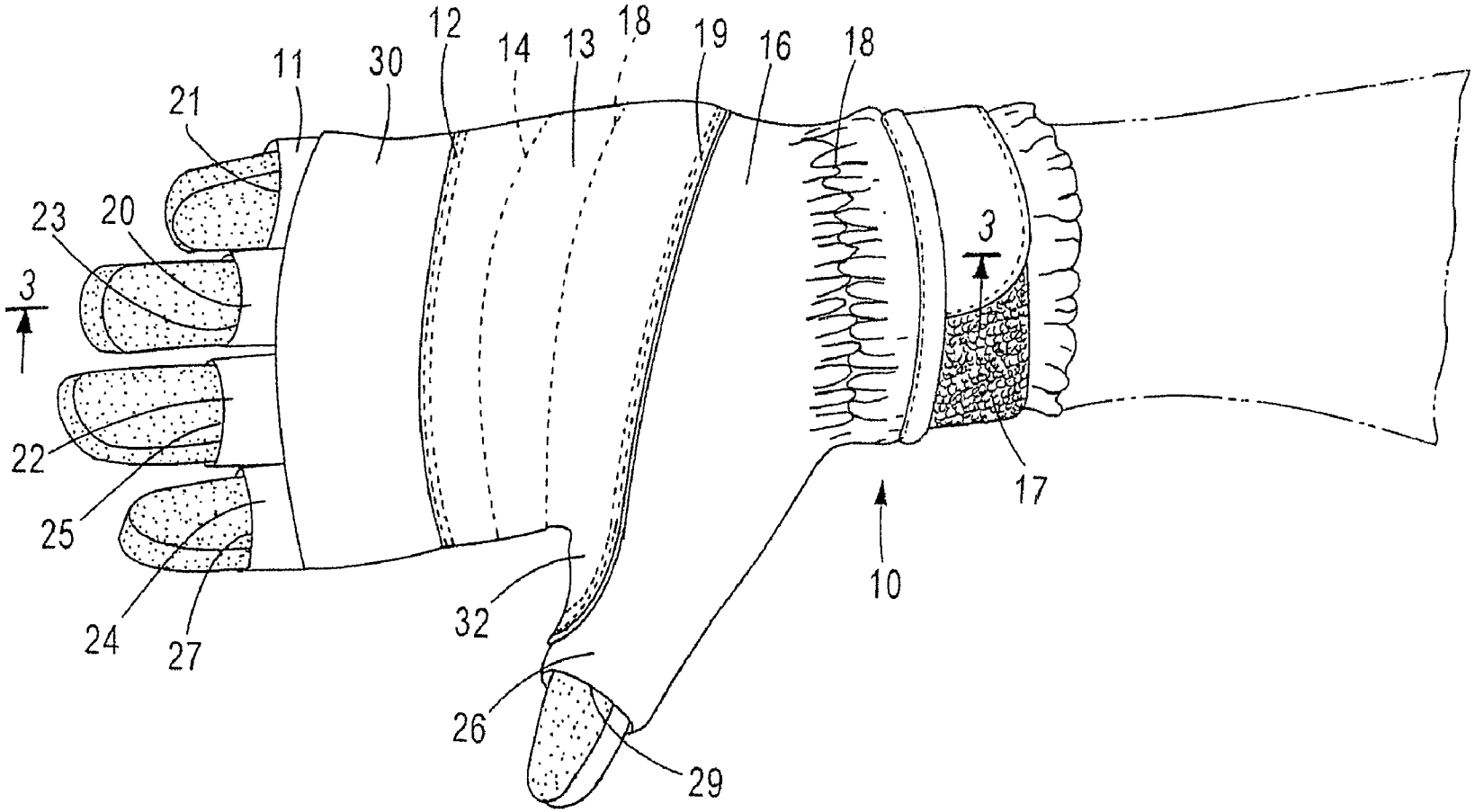
FIG. 2 is a perspective view of a composite of a rappeller's glove according to this invention in combination with a shooter's glove viewed from the front of the composite glove structure.
Figure 3:
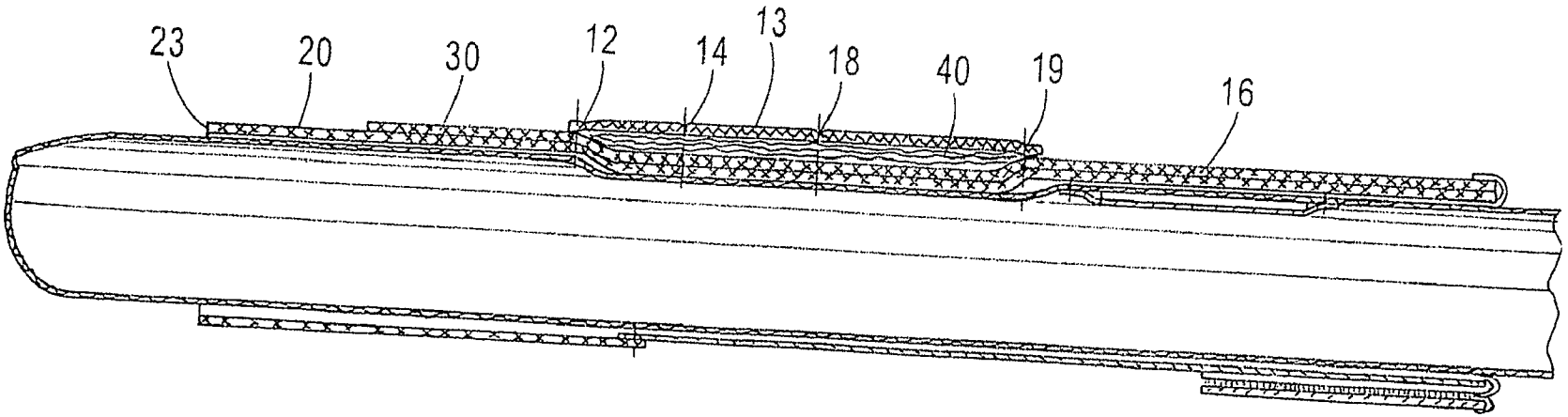
FIG. 3 is a sectional view of a rappeller's glove according to this invention with the section taken along the line 3—3 in FIG. 1, looking in the direction of the arrows.

A rappeller's glove 10 of this invention comprises a body portion 16 that is so sized and shaped to fit snugly over the palm and back of the operator's hand (not shown) or over a shooter's glove (shown at 17 in FIG. 2). The body portion 16 of the rapeller's glove 10 has a snugging elastic member 18 disposed at or very near to its proximal end. The distal end of the body member 16 has several finger elements 11, 20, 22, and 24 and a thumb element 26 extending outwardly therefrom. It is to be noted that the depicted finger elements are sized so that they are adapted to extend only part way along the finger lengths of the user. This is a preferred aspect of this invention, but not a necessary one. If desired, the finger elements can be made to fit the complete lengths of one or more fingers. In the preferred aspect, the finger elements have end in openings 21, 23, 25, 27 and 29, respectively. In a preferred embodiment, these "half fingers" are made to a length such that they are adapted to extend to between the first and the second knuckle of each finger. As noted above, the index, or trigger, finger may be a "half" length and the other finger elements may completely or partially cover their respective fingers. When it is being worn, the rappeller's glove 10 of this invention is intended to be disposed over a shooter's glove 17 (shown in FIG. 2).

The body of the rappeller's glove 10 has several features that are important to this invention. A palm protecting overlay material 13 is disposed across the palm area of the glove body portion 16. This overlay material 13 is suitably joined to the fabric of the glove 10 in a position that is proximate to the palm of the operator's hand. Thus it serves to protect the user's hand from heat and abrasion damage that might be caused sliding down a rope (rappelling). The palm protecting overlay material 13 is suitably attached to the glove body 16 by stitching or adhesive means 12, 14, 18 and 19. It is disposed between the thumb and the fingers and at least partially covers the thumb so that when the user's hand is clasped around a rappelling rope, no part of the rope comes into contact with an unpadded portion of the glove. It is considered to be a part of this invention to provide extra padding 40 the area between the overlay material 13 and the underlying glove body. The material from which the overlay element 13 is made is suitably a material that, at least initially, has a relatively low coefficient of friction with respect to the rope. One excellent material is leather, especially kangaroo leather. Kevlar® aramid material or other anti-ballistic materials, such as high molecular weight polyolefins, especially polyethylene, are excellent materials for this use as the padding 40 because it has high heat absorption characteristics.

Note that, as shown in the drawing, in a preferred aspect of this invention, padding 40 is disposed between the glove body 16 and the overlay material 13 at least in the area of the palm and the proximal portion of the thumb 32. Optionally, padding 40 can also be provided proximate to the base of the finger elements where protection is needed against possible contact with the rappelling rope.

In this preferred aspect of this invention, a small flap 30 of additional material, optionally an extension of the overlay material 13, is disposed across the area of the glove body 16 that extends from the padded palm area to part way out the finger lengths. It corresponds to the place where the finger element 11, 20, 22 and 24 join the body 16 of the glove 16. It is preferred that no padding be disposed between this flap 30 and the main body or the finger elements of the glove. The overlay material 13 may be a single sheet of rope burn resistant material, or it may be applied as a plurality of transverse strips. Either the single sheet of material is attached to the palm portion by means of a plurality of transverse adhesion (sewn or glued) lines whereby defining a plurality of discrete transverse padded areas, or the plurality of overlay strips may be individually attached to the palm portion whereby encasing a series of padding materials 40 within the confines of the attachment means. The use of a single sheet of material for the overlay material is preferred.

The padding and heat resistant material 40 is suitably applied in the area of the palm and proximal portion of the thumb 32. The padding 40 is preferably applied in transverse strips that are maintained separate by transversely stitching or gluing 12, 14, 15, and 19 down the overlay material. Alternatively, the padding may be a single batt of cushioning material that is transversely attached to the palm portion via a plurality of transverse attachment means (stitching or gluing), or it may be a plurality of narrower batts of cushioning material similarly held in place by stitching or gluing. The provision of a plurality of transverse cushioning areas is an important aspect of this invention as such structure will tend to prevent the glove material from bunching up during rappelling operations but rather will form a plural point contact with the rope.

The padding 40 may be kept in actually discrete transverse areas by stitching or gluing the overlay material tightly to the palm portion. In the alternative, the overlay material may be attached to the palm portion by looser stitching so that, while there is a separation of portion of the padding batt into relatively discrete transverse sections, the padding is not absolutely prevented from slight shifting during use. This structure enables the overlay portion of the rappeller's glove to fit smoothly against a rifle stock, or the like, by allowing the padding some movement.

The extra flap 30 is adapted to reinforce the protection to the hand afforded by the glove body. It is intended that this flap will not be so positioned that it grips the rope, at least not to a major extent, however, depending of the size of the rope, the size of the hand, and the size of the flap, there may be some contact between the rope and the flap 30.

It is within the scope of this invention to provide a securing strap across the back of the glove. This securing strap enables the wrist directed portion of the glove to be further tightened, which also tends to retard bunching up. While the snuggling elastic member 18 is resilient, the securing flap is preferably inelastic or minimally elastic and is adapted to be secured about the base of the glove, such as by a conventional loop and hook attachment. The securing of this flap tends to put strain on the snugging member, stretching the same and causing a very tight fit of the rappelling glove about the wist of the wearer. This tight fit, that is maintained by the combination of the elastic snugging member 18 and the substantially inelastic strip, both positioned at or very near to the wearer's wrist, keeps the rappelling glove firmly on the wearer's hand with the padded palm member correctly positioned over the wearer's palm and the base of the thumb so as to get maximum contact with, and therefore maximum control of, the rappelling rope.

Referring now to FIG. 2, it will be seen that the rappelling glove 10 is preferably worn over a shooter's glove 17. The shooter's glove 17 can be of any structure and arrangement that is suitable. In a preferred structure, the shooter's glove 17 has an elastic element in the portion covering the back of the hand near the wrist in order to keep the glove 17 in relatively fixed place with respect to the shooting hand (not shown). A gauntlet may be provided. If one is present, it suitably extends from the elastic wrist member up around the forearm of the shooter to protect the forearm from injury that might be caused by ejecting bullet casings or the like. As previously noted, it is suitable for the gauntlet to have an elastic member at its distal end (that is the end furthest from the wrist) in order to keep it snugly in place, but neither the gauntlet nor the distal elastic element are an essential element of the composite glove of this invention. The other elements of the shooter's glove shown in the drawing are consistent with the elements set forth in the parent applications. It will be noted that it is preferred that the shooter's, or underlying, glove portion extends somewhat further up the wrist of the wearer than does the rappelling, or overlying, portion of the instant composite glove.

The materials of construction of the rappelling glove, or a reinforcing palm pad, are generally those materials that have been used in the past for this activity. Especially leather, vinyl plastic and polyurethane are the most suitable materials adapted to be used as surfaces that contact the weapon and/or the rope, with leather being preferred. The padding can be accomplished by using multiple layers of these same materials. One preferred padding material will be antiballistic fabric disposed between the overlaying layer and the body portion of the overlying glove.

What is claimed is:

1. A composite glove structure comprising: a first and a second glove adapted to be worn in overlying relation to each other with said second glove disposed over said first glove, wherein said composite glove structure comprises:

a first glove structure comprising:

an opening at a base of said glove that is adapted to have a wearer's hand, comprising inserted there through;

a first palm portion; and at least one first finger portion that extends from said palm portion;

wherein at least a portion of at least one said first finger portion(s) is comprised of a woven or knitted textile material that will be subject to unraveling when cut;

wherein said textile material is interrupted by at least one cut ring disposed about at least a portion of said finger portion that is disposed between said palm portion and a distal end of said finger portion; and wherein said cut ring is disposed in operative relationship to at least said textile portion of said finger portion such that, when cut, it is adapted to substantially prevent unravelling of textile material disposed on a proximal side of said cut ring; and a second glove structure adapted to fit over said first glove structure and comprising:

a second palm portion adapted to at least partially superimpose over said first palm portion;

a thumb portion extending from and joined to said palm portion;

at least one second finger portion adapted to at least partially superimpose over a corresponding first finger portion;

wherein the length of at least one second finger portion is less than the length of the first finger portion over which it is adapted to be superimposed;

wherein said thumb portion and said at least one second finger portion(s) are of a length sufficient to be adapted to surround a rappelling rope disposed on said second palm portion;

an overlay strip disposed on said second palm portion and on a palm directed base of said thumb portion;

wherein said overlay strip is comprised of a material that is adapted to withstand substantial abrasion by sliding contact between said rappelling rope and said overlay strip and is of a size such that, when a gloved hand is holding said rappelling rope, at least a majority portion of said rappelling rope contacts said overlay strip;

padding contained in a plurality of substantially discrete, elongated pouches disposed substantially transverse to said palm portion;

wherein said discrete pouches containing said padding are positioned below said overlay strip and attached along a plurality of areas that are substantially transverse to said palm portion; and a flap extending between said overlay strip and a location between the proximal and distal ends of at least one second said finger portions.

2. A composite glove as claimed in claim 1 further comprising a back on at least one of said glove structures.

3. A composite glove as claimed in claim 2 wherein said second glove structure comprises a back.

4. A composite glove as claimed in claim 1 wherein said back is at least partially elastic.

5. A composite glove as claimed in claim 1 comprising antiballistic fabric.

6. A composite glove as claimed in claim 1 wherein said at least one second finger portion(s) are substantially shorter than fingers they are adapted to cover.

7. A composite glove as claimed in claim 1, wherein said second finger portion that is adapted to be superimposed over the first finger portion having said cut ring is of a length tat is not longer than the distance between the first palm portion and the cut ring such that a trigger finger is adapted to be exposed out of said cut ring and said overlying second finger portion.

8. A pair of composite gloves comprising one composite glove structure as claimed in claim 1.

9. A composite glove as claimed in claim 1 wherein said first finger portion having said cut ring is adapted to fit over an index finger.

* * * * *

UNITED STATES PATENT AND TRADEMARK OFFICE

CERTIFICATE OF CORRECTION

PATENT NO. : 7,107,623 B2
APPLICATION NO. : 11/064660
DATED : November 21, 2006
INVENTOR(S) : William Hatch et al.

It is certified that error appears in the above-identified patent and that said Letters Patent is hereby corrected as shown below:

Column 3, line 13, change “mole” to --more--; line 18, change “tills” to --this--; line 38, change “oil” to --on--.

Column 4, line 4, change “skill” to --skin--; line 11, after “gauntlet” insert --is made--; line 26, delete “glove”; line 26, change “materials” to --material--; line 28, change “poly (1,4-phenylene, 2,6-benizbisoxazole)” to --poly(1,4-phenylene, 2,6-benzbisoxazole)--; and line 41, delete “not only”.

Column 5, line 51, delete “a”.

Column 9, line 48, delete “have”.

Column 11, line 63, delete “comprising”; and line 64 after “through” insert --and comprising--.

Signed and Sealed this

Sixteenth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,107,623 B2
APPLICATION NO. : 11/064660
DATED : September 19, 2006
INVENTOR(S) : William Hatch et al.

It is certified that error appears in the above-identified patent and that said Letters Patent is hereby corrected as shown below:

Column 3, line 13, change “mole” to --more--; line 18, change “tills” to --this--; line 38, change “oil” to --on--.

Column 4, line 4, change “skill” to --skin--; line 11, after “gauntlet” insert --is made--; line 26, delete “glove”; line 26, change “materials” to --material--; line 28, change “poly (1,4-phenylene, 2,6-benizbisoxazole)” to --poly(1,4-phenylene, 2,6-benzbisoxazole)--; and line 41, delete “not only”.

Column 5, line 51, delete “a”.

Column 9, line 48, delete “have”.

Column 11, line 63, delete “comprising”; and line 64 after “through” insert --and comprising--.

This certificate supersedes Certificate of Correction issued January 16, 2007.

Signed and Sealed this

Sixth Day of February, 2007

JON W. DUDAS
*Director of the United States Patent and Trademark Office*